US007388502B2

(12) United States Patent
Silvestri

(10) Patent No.: US 7,388,502 B2
(45) Date of Patent: Jun. 17, 2008

(54) SAFETY SHOES, PROTECTIVE SHOES, WORKING SHOES FOR PROFESSIONAL USE, EQUIPPED TO ALLOW IDENTIFICATION AND TO MEMORIZE OTHER DATA

(75) Inventor: Gianni Silvestri, Ascoli Piceno (IT)

(73) Assignee: Safe Way S.r.l., Prato (IT)

( * ) Notice: Subject to any disclaimer, the term of this patent is extended or adjusted under 35 U.S.C. 154(b) by 165 days.

(21) Appl. No.: 10/522,453

(22) PCT Filed: Jul. 21, 2003

(86) PCT No.: PCT/IT03/00450

§ 371 (c)(1),
(2), (4) Date: Sep. 22, 2005

(87) PCT Pub. No.: WO2004/008900

PCT Pub. Date: Jan. 29, 2004

(65) Prior Publication Data

US 2006/0117610 A1 Jun. 8, 2006

(30) Foreign Application Priority Data

Jul. 24, 2002 (IT) ..... FI2002A0138

(51) Int. Cl.
*G08B 13/14* (2006.01)

(52) U.S. Cl. ..... 340/572.8; 340/572.1; 340/10.1; 340/5.2; 235/492; 235/375

(58) Field of Classification Search ..... 340/572.8, 340/568.1, 572.1, 568.6, 5.2, 5.4, 5.6, 5.61, 340/5.7, 5.8

See application file for complete search history.

(56) References Cited

U.S. PATENT DOCUMENTS

| | | | | |
|---|---|---|---|---|
| 4,870,700 | A * | 9/1989 | Ormanns et al. | 455/92 |
| 5,079,541 | A * | 1/1992 | Moody | 340/573.4 |
| 5,557,259 | A * | 9/1996 | Musa | 340/573.4 |
| 5,574,431 | A * | 11/1996 | McKeown et al. | 340/572.3 |
| 6,563,423 | B2 * | 5/2003 | Smith | 340/572.1 |
| 6,788,200 | B1 * | 9/2004 | Jamel et al. | 340/539.13 |

FOREIGN PATENT DOCUMENTS

| | | |
|---|---|---|
| DE | 299 16 238 | 2/2000 |
| FR | 2 800 245 | 5/2001 |
| JP | 02161561 | 6/1990 |
| JP | 10320603 | 12/1998 |

* cited by examiner

*Primary Examiner*—Benjamin C. Lee
*Assistant Examiner*—Travis R. Hunnings
(74) *Attorney, Agent, or Firm*—McGlew and Tuttle P.C.

(57) ABSTRACT

Personal protective equipment (PPE) such as safety, protective or working shoe for professional use and the like equipped with a transponder designed to identify the item, with memorization of the number or name of the article, the class and/or other peculiar characteristics, the size, the color, the date of manufacture and any other data and also if need be to monitor the data relative to its being placed in use, treatments performed and other events, and also to allow identification of the user, said transponder being designed to supply the data to a reading and processing and/or reporting means, through a univocal code contained in the transponder.

16 Claims, 2 Drawing Sheets

SAFETY SHOES, PROTECTIVE SHOES, WORKING SHOES FOR PROFESSIONAL USE, EQUIPPED TO ALLOW IDENTIFICATION AND TO MEMORIZE OTHER DATA

BACKGROUND OF THE INVENTION

Safety, protective and working shoes for professional use becomes dirty through use and moreover its performance tends to decrease due to treatments performed such as washing, sterilization, wear and the like.

In the case of shoes for professional use a certain number must be collected, to perform treatment such as washing, sterilization or other treatment cumulatively and simultaneously, and therefore they must be returned to the individual owners and/or users.

SUMMARY AND OBJECT OF THE INVENTION

The invention above all relates to the incorporation of a transponder in the shoe, to allow identification that is certain, rapid and automatic by means of specific readers designed to receive data from the transponder.

The invention also allows—by means of the transponder—each shoe to be given a certain number of data or in any case these data to be associated by means of a univocal code contained in the transponder. This makes it possible to identify who they belong to, the time they have been in use, the number and type of treatments performed and as a function of these the state of preservation and/or remaining performance to avoid exceeding the limits beyond which the performance that the shoe is required to provide may be impaired.

The invention makes it possible to implement checks and identifications, even with substantially automated operations, facilitating both management of treatments and safety of checks.

The invention makes it possible to identify the class and/or peculiar characteristics of each item and to verify its consistency in the case of access to specific work areas (highly dangerous areas, clean rooms, etc.) and, by means of specific apparatus, to allow access or not, or in any case to detect and/or report the ascertained deficiencies.

To obtain the above, each shoe or pair of shoes is equipped with a transponder which is incorporated such as to make loss and/or replacement reasonably difficult and/or easy to identify. The transponder is capable of monitoring the data relative to the shoe, who it belongs to and if necessary also the number and the type of treatments performed and any other information of interest concerning the item in which the transponder is incorporated.

In the specific case of safety shoes, protective shoes and working shoes for professional use, this comprises a transponder which may be incorporated in the sole or in other parts of the shoe, during manufacture, or—by providing specific housings—in a subsequent phase.

It may also be possible to re-use the same personalized transponder, to be used subsequently by the user by inserting it in shoes used subsequently to replace worn shoes.

In an advantageous embodiment, the transponder may contain a univocal code, by means of which the information mentioned above may be associated by means of a data processing system, designed to dialog with the transponders.

Another object of the invention is a process that is particularly suitable to produce safety, protective and working shoes for professional use, with the injection and/or molding system of the bottom that today represents the most widely used system in the production of shoes.

In the process—which entails producing the bottom by injection into a mould in which a last is position on which the upper and relative insole are fitted—a transponder is positioned in the mould prior to injection and/or introduction of the plastic material to form the sole; therefore said transponder is incorporated in the actual sole. In practice, said transponder may be made to adhere to the exposed surface of the insole, mounted on the last, before this is positioned in the mould.

It being stated that the position of the transponder may differ from the one indicated in the example hereunder, the invention shall now be better understood by following the description and accompanying drawing, which shows a non-limiting practical embodiment of the invention, relating to a safety, protective and working shoe for professional use. In the drawing:

DETAILED DESCRIPTION OF THE PREFERRED EMBODIMENT

Figure 1:
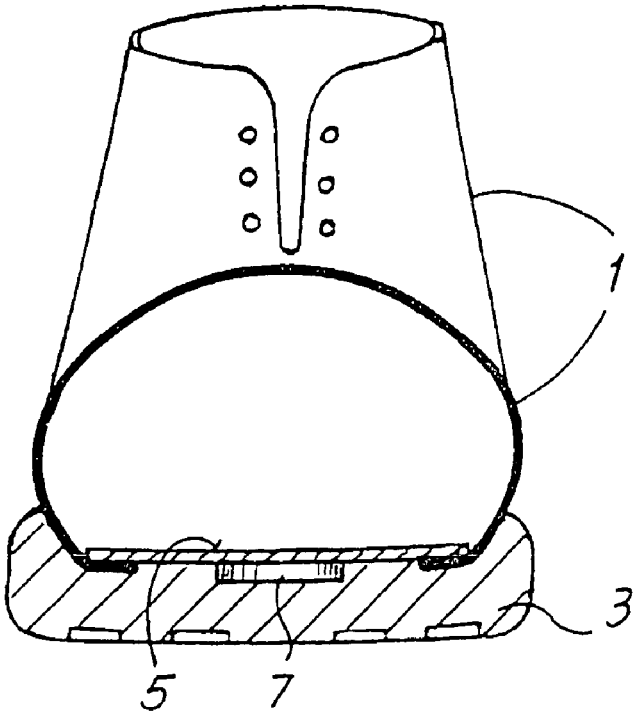
FIG. 1 summarily shows, in a cross-section, a shoe equipped with transponder according to the invention.

According to what is illustrated in the drawing, 1 indicates the upper of the shoe and 3 indicates the sole or bottom of the shoe; 5 indicates the insole that completes the shoe.

According to the invention, a transponder 7 is combined with the shoe, and particularly with the sole or bottom of this shoe; this transponder in practice is positioned between the sole 3 and the insole 5, being more or less incorporated in the sole produced with the injection and/or molding system.

The transponder may be combined with the shoe in any suitable way, also by combining the insole 5 with the pre-constructed sole 3, producing in the sole 3 a seat designed to house the transponder 7. Said seat may be produced in any way, at the side or on the top or in other positions of the sole.

When—as in the majority of cases—production of a shoe of the aforesaid type is performed by directly molding the sole onto the upper 1 and the insole 5, mounted on a last, this molding operation may also be used to incorporate the transponder.

Figure 2:
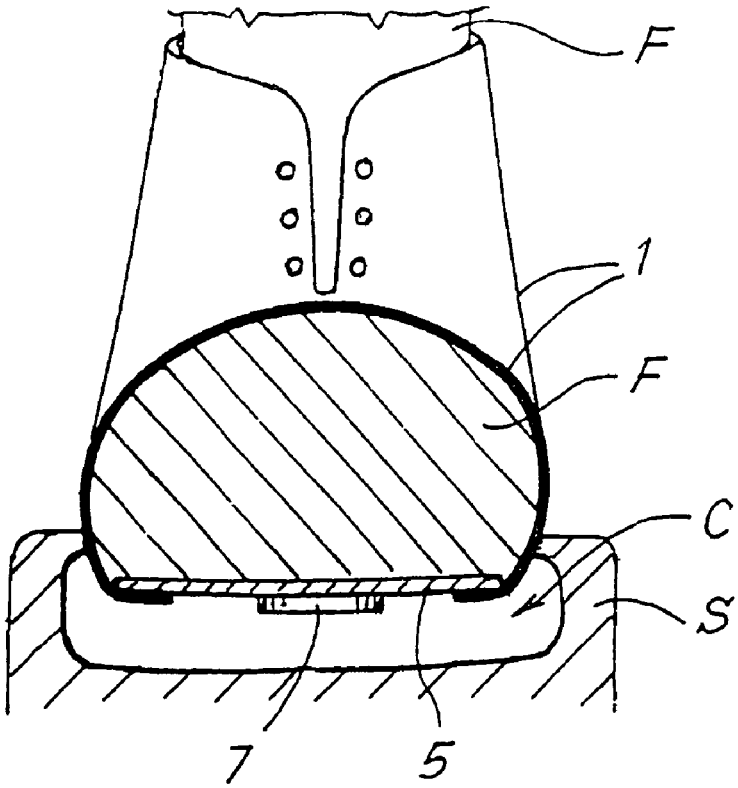
FIG. 2 shows in a cross-section at last with upper and insole combined with a mould for injection and/or molding of the sole or bottom of the shoe.

FIG. 2 shows a last F—on which the structure formed of the upper 1 and the insole 5 has been fitted—according to a known technique said last being combined with a mould S shown summarily, which is provided with a cavity C that is delimited by the assembly of the last with the parts combined on it, so that it closes the cavity C. It is thus possible to inject thermoplastic resin to form the sole, which is modeled according to the shape of the cavity C completed by the structure of the last F and the parts applied to it.

To incorporate the transponder 7, this may be simply applied to the exposed surface of the insole 5 of the assembly 1, 5 mounted on the last F. Therefore the transponder 7 is located in the cavity C which will be filled with injected thermoplastic resin. The transponder 7 will in this way be incorporated in the resin and thus in the sole produced. Therefore, combination of the transponder with the shoe takes place with an extremely simple operation, equivalent to traditional operations to produce safety, protective and working shoes for professional use, like the one defined above with the sole molded on the last equipped with upper and insole; the only additional operation is the operation to position the transponder against the insole before positioning the last against the mould.

Figure 3:
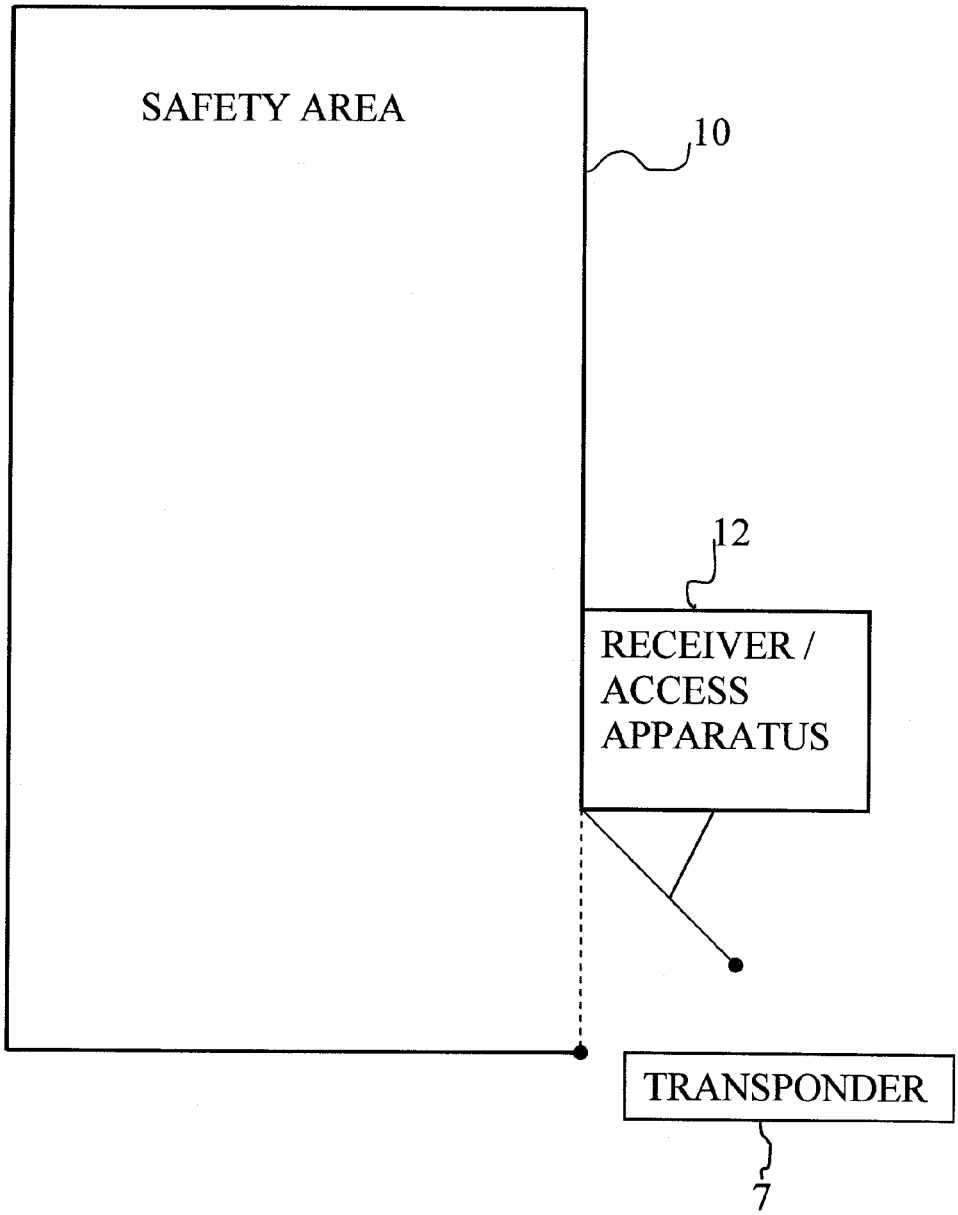
FIG. 3 is a schematic plan view of the receivers/access apparatus controlling access to the safety area.

FIG. 3 shows how the safety or work shoe of the present invention can be used with a safety or work area 10 that requires a particular type of shoe. The transponder 7 transmits the data, which includes safety data indicating a safety class of the shoe, to a receiver/access apparatus 12. The receivers/access apparatus 12 then determines to allow or deny access.

It is understood that the drawing only shows an example, provided purely as a practical illustration of the invention, and that said invention may vary in forms and arrangements without however departing from the scope of the concept forming the invention.

The invention also provides that the transponder may be combined with the shoe by positioning it in the upper or in accessory parts of it, in a specific housing.

In some cases safety, protective or working shoes may be implemented with the transponder positioned in such a way that it can be recovered and re-used.

The invention claimed is:

1. A safety shoe for professional use, said safety shoe comprising:

a shoe body with a safety class;

a transponder mounted on said shoe body and supplying data to allow identification of the shoe, said data including safety data allowing identification of said safety class to which the shoe belongs and/or verification of a consistency of said safety class of the shoe when accessing a specific working area.

2. A shoe as claimed in claim 1, wherein a manufacturing date of the shoe is stored in said transponder.

3. A shoe according to claim 1, wherein data allowing monitoring of treatments performed on said shoe are stored in said transponder.

4. A shoe according to claim 1, wherein said transponder further includes one or more of the following: a number/name of said shoe; a size of the shoe; a color of the shoe; a univocal code identifying the shoe; user identification data.

5. A shoe as claimed in claim 1, wherein said transponder is incorporated in said shoe body so as to make any loss and/or replacement reasonably difficult and/or easy to identify.

6. A shoe as claimed in claim 1, wherein said transponder is positioned in such a way that it may be recovered and re-used.

7. A shoe as claimed in claim 1, wherein said transponder is incorporated in a bottom of the shoe.

8. A shoe as claimed in claim 1, wherein said transponder is inserted between an insole and a sole of said shoe body.

9. A shoe as claimed in claim 1, wherein said transponder is inserted in an upper or in accessory parts of said upper in a specific housing.

10. A pair of safety shoes according to claim 1, wherein each shoe of said pair includes a transponder, said transponders including data for returning said pair of shoes to an individual owner or user.

11. A safety shoe system comprising:

a shoe body constructed according to a safety class;

a transponder mounted on said shoe body and including safety data identifying said safety class of said shoe body, said transponder including a transmitter for transmitting said safety data.

12. A system in accordance with claim 11, further comprising:

a receiver spaced from said shoe body and receiving said safety data transmitted by said transponder;

an access apparatus associated with a safety area, said access apparatus being connected to said receiver and receiving said safety data from said receiver, said access apparatus determining if said shoe body and said transponder have access to said safety area based on said safety data.

13. A shoe as claimed in claim 11, wherein:

said safety data includes a manufacturing date of said shoe body.

14. A shoe as claimed in claim 11, wherein:

said safety data includes treatments performed on said shoe body.

15. A shoe as claimed in claim 11, wherein:

said safety data includes identification of said shoe body.

16. A safety shoe method comprising the steps of:

providing a shoe body constructed according to a safety class;

providing a transponder mounted on said shoe body and including safety data identifying said safety class of said shoe body;

transmitting said safety data to a safety area;

determining if said shoe body and said transponder have access to said safety area based on said safety data.

* * * * *